US010392676B2

(12) United States Patent
Katsumata et al.

(10) Patent No.: US 10,392,676 B2
(45) Date of Patent: Aug. 27, 2019

(54) HEAT TREATMENT DEVICE AND COOLING DEVICE

(71) Applicants: IHI Corporation, Tokyo (JP); IHI Machinery and Furnace Co., Ltd., Tokyo (JP)

(72) Inventors: Kazuhiko Katsumata, Inuyama (JP); Kaoru Isomoto, Tokyo (JP); Gen Nishitani, Kakamigahara (JP); Akira Nakayama, Hikari (JP); Takahiro Nagata, Kamo-gun (JP); Yuusuke Shimizu, Gifu (JP)

(73) Assignees: IHI CORPORATION, Tokyo (JP); IHI MACHINERY AND FURNACE CO., LTD., Tokyo (JP)

( * ) Notice: Subject to any disclaimer, the term of this patent is extended or adjusted under 35 U.S.C. 154(b) by 223 days.

(21) Appl. No.: 15/446,251

(22) Filed: Mar. 1, 2017

(65) Prior Publication Data

US 2017/0175214 A1 Jun. 22, 2017

Related U.S. Application Data

(63) Continuation of application No. PCT/JP2015/081150, filed on Nov. 5, 2015.

(30) Foreign Application Priority Data

Nov. 20, 2014 (JP) ..... 2014-235441

(51) Int. Cl.
*F27D 19/00* (2006.01)
*F27D 7/04* (2006.01)
(Continued)

(52) U.S. Cl.
CPC ..... *C21D 9/0006* (2013.01); *C21D 1/00* (2013.01); *C21D 1/60* (2013.01); *C21D 1/667* (2013.01); *C21D 9/0062* (2013.01); *C21D 1/62* (2013.01)

(58) Field of Classification Search
CPC ..... C21D 9/0006; C21D 9/0062
See application file for complete search history.

(56) References Cited

U.S. PATENT DOCUMENTS 4,066,477 A 1/1978 Böckenhoff et al.
5,273,585 A * 12/1993 Shoga ..... C21D 1/74 118/719

(Continued)

FOREIGN PATENT DOCUMENTS

AT 345870 B 10/1978
CN 102308008 A 1/2012

(Continued)

*Primary Examiner* — Scott R Kastler
(74) *Attorney, Agent, or Firm* — Rothwell, Figg, Ernst & Manbeck, P.C.

(57) ABSTRACT

A heat treatment device includes: a heating device that heats a treatment object; a cooling device including a cooling room that accommodates the treatment object heated by the heating device and into which a cooling medium used for cooling the treatment object is supplied; a pressurized gas supplier that supplies pressurized gas into the cooling room; a pressure relief valve that communicates internal and external areas of the cooling room with each other when the pressure relief valve is opened; a pressure sensor that measures the pressure inside the cooling room; and a controller that controls the pressure relief valve such that the pressure relief valve is opened when a measurement result of the pressure sensor is higher than or equal to a threshold value.

10 Claims, 3 Drawing Sheets

(51) Int. Cl.

| | |
|---|---|
| ***C21D 9/00*** | (2006.01) |
| ***C21D 1/00*** | (2006.01) |
| ***C21D 1/60*** | (2006.01) |
| ***C21D 1/667*** | (2006.01) |
| *C21D 1/62* | (2006.01) |

(56) References Cited

U.S. PATENT DOCUMENTS

| | | | | |
|---|---|---|---|---|
| 9,181,600 | B2 | 11/2015 | Katsumata | |
| 2009/0269713 | A1 | 10/2009 | Choi | |
| 2011/0275024 | A1 | 11/2011 | Katsumata | |
| 2012/0247627 | A1 | 10/2012 | Grobler et al. | |
| 2013/0008567 | A1 | 1/2013 | Katsumata | |
| 2013/0153547 | A1 | 6/2013 | Katsumata | |
| 2017/0175214 | A1* | 6/2017 | Katsumata | C21D 1/00 |

FOREIGN PATENT DOCUMENTS

| | | | |
|---|---|---|---|
| JP | 59-41426 | A | 3/1984 |
| JP | 5-17817 | A | 1/1993 |
| JP | 11-310819 | A | 11/1999 |
| JP | 2004-131789 | A | 4/2004 |
| JP | 2009-532658 | A | 9/2009 |
| JP | 2011-202228 | A | 10/2011 |
| JP | 2012-13341 | A | 1/2012 |
| JP | 2012-17498 | A | 1/2012 |
| JP | 2012-207306 | A | 10/2012 |

* cited by examiner

HEAT TREATMENT DEVICE AND COOLING DEVICE

CROSS-REFERENCE TO RELATED APPLICATIONS

This application is a Continuation Application based on International Application No. PCT/JP2015/081150, filed Nov. 5, 2015, which claims priority on Japanese Patent Application No. 2014-235441, filed Nov. 20, 2014, the contents of which are incorporated herein by reference.

TECHNICAL FIELD

The present disclosure relates to a heat treatment device and a cooling device.

BACKGROUND

In the related art, in order to perform treatment such as hardening on a metal part that is a treatment object, a heat treatment device is used that includes a heating room and a cooling room. For example, Patent Document 1 discloses a heat treatment device in which heating rooms are provided above an intermediate transfer room and a cooling room is provided below the intermediate transfer room. In general, the cooling room of the heat treatment device or the like is provided with a coolant collection and supply device (a cooling medium circulator) that collects a coolant (a cooling medium) from the cooling room, cools the collected coolant and supplies the coolant to the cooling room. For example, the coolant collection and supply device includes a coolant tank that stores the coolant collected from the cooling room, a cooling pump that pumps the coolant stored in the coolant tank into header pipes (mist headers) of the cooling room, and a heat exchanger that cools the coolant pumped by the cooling pump. In addition, the cooling room is provided with, for example, mist nozzles (cooling nozzles) that spray, onto the treatment object, the coolant supplied from the coolant collection and supply device. The treatment object is deprived of heat through vaporization of the coolant sprayed from the mist nozzles and thus is cooled.

DOCUMENT OF RELATED ART

Patent Document

[Patent Document 1] Japanese Unexamined Patent Application, First Publication No. 2012-13341

SUMMARY

Technical Problem

In the above related art, during spray of the coolant from the mist nozzles onto the treatment object, vapor generated through vaporization of the coolant is cooled by mist (a coolant) sprayed from the mist nozzles and is changed into droplets, and the droplets drop down. However, in the above related art, for example, in a case where a spray stop period in which the supply of the coolant is suspended during cooling for the treatment object is provided in order to equalize the temperatures of the inside and the surface of the treatment object, if the spray stop period starts in a state where the temperature of the treatment object is still high, while vapor continues being generated through vaporization of the coolant attached to the treatment object, the generated vapor remains inside the cooling room without being cooled by mist supplied from the nozzles, and thus the internal pressure of the cooling room may increase. Therefore, in the above related art, an unfavorable situation such as an emergency stop of the heat treatment device may be caused due to the increase of the internal pressure of the cooling room, and the processing efficiency of the treatment object may deteriorate.

The present disclosure has been made in view of the above circumstances, and an object thereof is to provide a heat treatment device and a cooling device that can prevent increase of the internal pressure of a cooling room.

Solution to Problem

In order to reach the above object, a first aspect of the present disclosure is a heat treatment device including: a heating device that heats a treatment object; a cooling device including a cooling room that accommodates the treatment object heated by the heating device and into which a cooling medium used for cooling the treatment object is supplied; a pressurized gas supplier that supplies pressurized gas into the cooling room; a pressure relief valve that communicates internal and external areas of the cooling room with each other when the pressure relief valve is opened; a pressure sensor that measures the pressure inside the cooling room; and a controller that controls the pressure relief valve such that the pressure relief valve is opened when a measurement result of the pressure sensor is higher than or equal to a threshold value. In addition, the cooling device is configured such that at least one stop period of supply of the cooling medium into the cooling room is provided during cooling for the treatment object.

A second aspect of the present disclosure is that in the heat treatment device of the first aspect, a pipe capable of communicating the internal and external areas of the cooling room with each other is connected to the cooling room. In addition, the pressure relief valve is provided in the pipe and is capable of closing the pipe.

A third aspect of the present disclosure is that in the heat treatment device of the second aspect, the pipe is an overflow pipe through which the cooling medium is drained from the cooling room.

A fourth aspect of the present disclosure is a cooling device including: a cooling room that accommodates a treatment object and into which a cooling medium used for cooling the treatment object is supplied; a pressurized gas supplier that supplies pressurized gas into the cooling room; a pressure relief valve that communicates internal and external areas of the cooling room with each other when the pressure relief valve is opened; a pressure sensor that measures a pressure inside the cooling room; a controller that controls the pressure relief valve such that the pressure relief valve is opened when a measurement result of the pressure sensor is higher than or equal to a threshold value.

Effects

According to the present disclosure, even if the pressure inside the cooling room inappropriately increases, since the pressure relief valve is opened through control of the controller and the internal and external areas of the cooling room communicate with each other through the pressure relief valve, gas (vapor) inside the cooling room can be released into the external area, and thus the pressure inside the cooling room can be brought to be equal to the atmospheric pressure. Therefore, it is possible to prevent inappropriate increase of the internal pressure of the cooling room compared to the atmospheric pressure.

DESCRIPTION OF EMBODIMENTS

Figure 1:
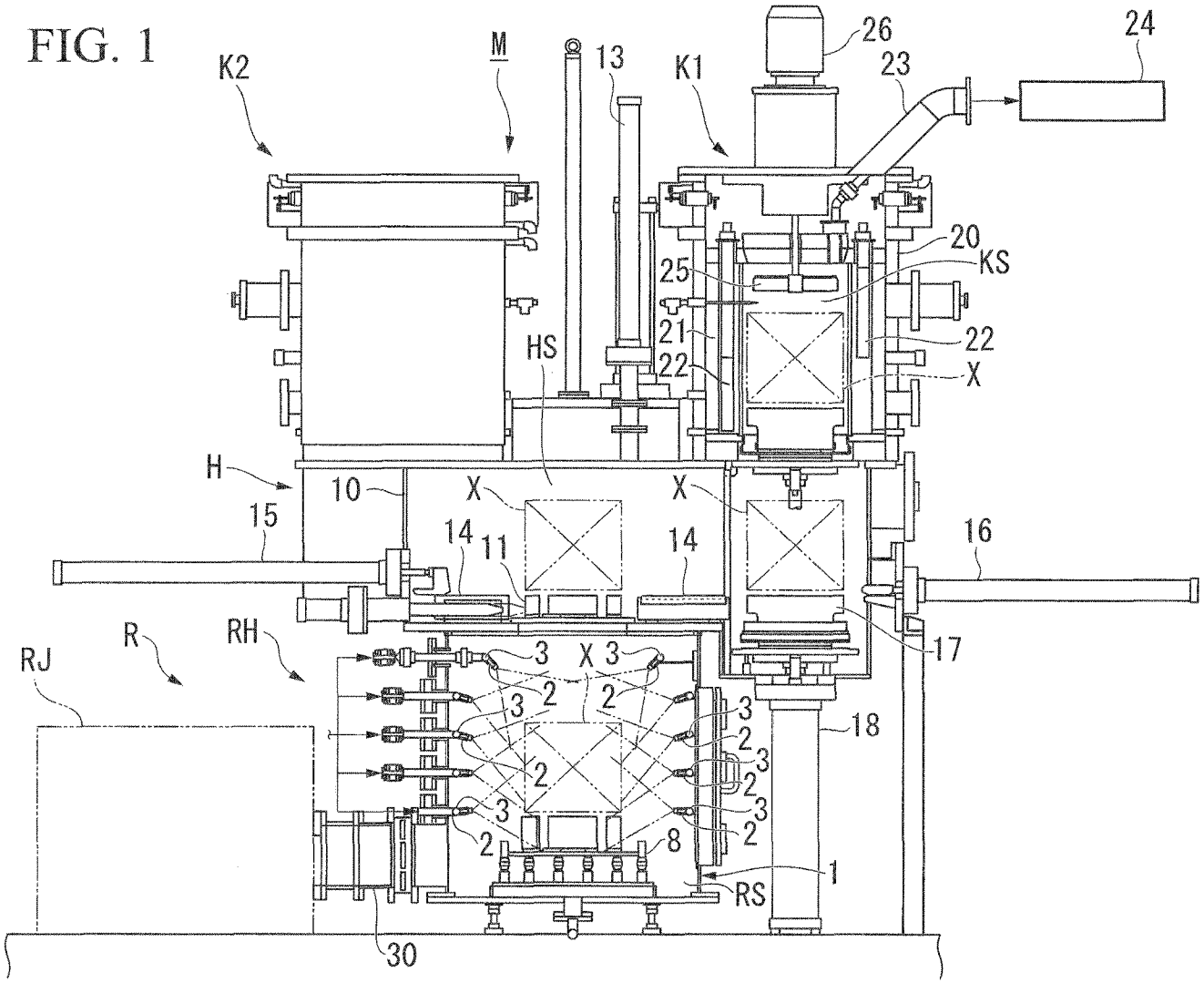
FIG. 1 is a vertical cross-sectional view showing a schematic configuration of a heat treatment device of an embodiment of the present disclosure.

Hereinafter, an embodiment of the present disclosure is described with reference to the drawings. In the drawings, the scale of each member is appropriately changed in order to show each member in a recognizable size.

As shown in FIG. 1, a heat treatment device M of this embodiment is a device in which a cooling device R, an intermediate transfer device H and two heating devices K1 and K2 are united. Although the heat treatment device of this embodiment includes a third heating device, since FIG. 1 shows a vertical cross-section including the center of the cooling device R, the third heating device is omitted therefrom.

Figure 2:
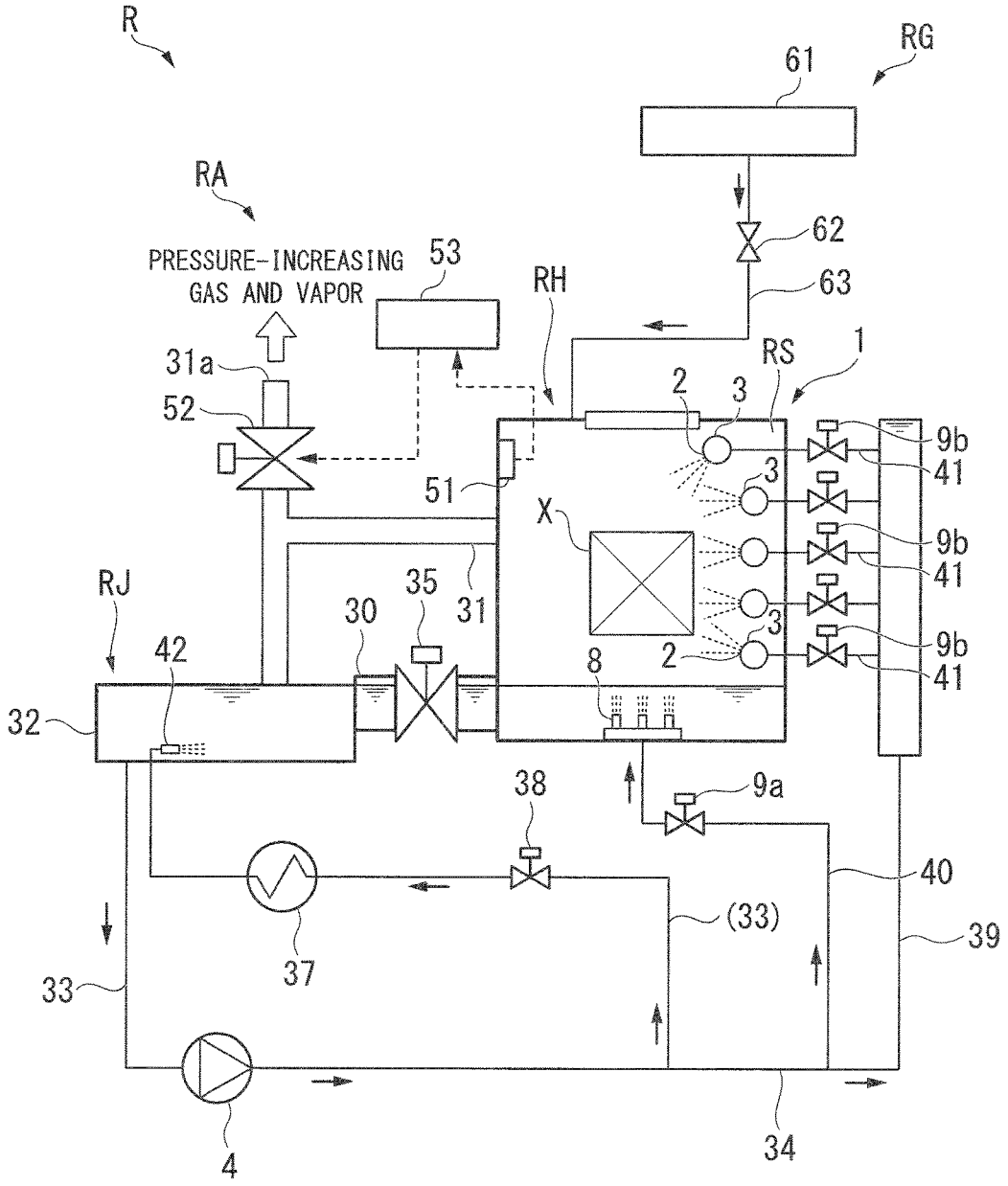
FIG. 2 is a schematic view of a cooling device of the embodiment of the present disclosure.

The cooling device R shown in FIGS. 1 and 2 is configured including a cooling device main body RH, a cooling medium circulator RJ, a pressure stabilizer RA and a pressurized gas supply device RG (a pressurized gas supplier). The cooling device main body RH makes a cooling medium contact a treatment object X accommodated in a cooling room RS and thereby cools the treatment object X. The cooling medium circulator RJ is provided in the cooling device main body RH as shown in FIG. 2, collects the cooling medium having been used for cooling at the cooling device main body RH, and cools and circulates the collected cooling medium through the cooling device main body RH. The pressure stabilizer RA stabilizes the gas pressure inside the cooling room RS at a pressure approximate to the atmospheric pressure. The pressurized gas supply device RG supplies pressurized gas (for example, nitrogen gas or air) into the cooling room RS, and the pressurized gas is used for increasing the gas pressure inside the cooling room RS. Hereinafter, the "gas pressure" inside the cooling room RS is merely referred to as the "pressure" inside the cooling room RS.

As shown in FIG. 1, the cooling device main body RH includes a cooling chamber 1, cooling nozzles 2, mist headers 3 and the like.

The cooling chamber 1 is a vertical cylindrical casing (a casing whose central axis line is parallel with the vertical direction), and the internal space of the cooling chamber 1 is the cooling room RS. The upper part of the cooling chamber 1 is connected to the intermediate transfer device H, and the cooling chamber 1 is provided with an opening through which the cooling room RS is communicated with the internal space (a transfer room HS) of the intermediate transfer device H. The treatment object X is loaded into and unloaded from the cooling room RS through the opening.

The cooling nozzles 2 are dispersedly arranged around the treatment object X accommodated in the cooling room RS. In detail, the cooling nozzles 2 are dispersedly arranged around the treatment object X in multistage (in detail, in five stages) in the vertical direction at regular intervals in the circumferential direction of the cooling chamber 1 (the cooling room RS) such that the cooling nozzles 2 surround the entire treatment object X and such that the difference between the distances between the treatment object X and the cooling nozzles 2 becomes the minimum.

For example, cooling nozzles 2 belonging to the uppermost stage are grouped into two nozzle groups, and the mist header 3 is provided in each of the two nozzle groups. Cooling nozzles 2 belonging to each of the lowermost stage and the intermediate three stages are grouped into three nozzle groups, and the mist header 3 is provided in each of the three nozzle groups. Each cooling nozzle 2 of each nozzle group is adjusted such that the nozzle axis thereof heads toward the treatment object X and sprays, onto the treatment object X, the cooling medium supplied through the mist header 3 from a cooling pump 4 of the cooling medium circulator RJ shown in FIG. 2.

As shown in FIG. 1, the cooling nozzles 2 belonging to the uppermost stage are disposed in positions higher than the upper end of the treatment object X in the vertical direction. The cooling nozzles 2 belonging to the lowermost stage are disposed in positions whose heights are approximately the same as that of the lower end of the treatment object X. The cooling nozzles 2 belonging to the uppermost stage are disposed to be closer to the center of the cooling chamber 1 (closer to the vertical central axis line of the cooling chamber 1) than the cooling nozzles 2 of the other stages, that is, are disposed to be further from the inner surface of the cooling chamber 1 than the cooling nozzles 2 of the other stages.

The cooling medium is a liquid having a lower viscosity than that of cooling oil that is generally used for cooling during heat treatment, and water is used for the cooling medium in this embodiment. The shapes of spray holes of the cooling nozzle 2 are set such that cooling water serving as the cooling medium is sprayed with a predetermined spray angle in a state of droplets that are uniform and have a constant droplet diameter. The spray angle of each cooling nozzle 2 and the separation between cooling nozzles 2 next to each other are set such that droplets sprayed and spread from a cooling nozzle 2 cross or contact droplets sprayed and spread from another cooling nozzle 2 next thereto.

That is, the cooling nozzles 2 spray the cooling water onto the treatment object X such that a mass of droplets of the cooling medium, namely mist of the cooling water, surrounds the entire treatment object X. The above cooling water mist may be formed of droplets having a constant droplet diameter with a constant mist density around the treatment object X.

The cooling device main body RH of this embodiment cools the treatment object X using the above cooling water mist, that is, mist-cools the treatment object X. The cooling conditions for the cooling device main body RH such as a cooling temperature and a cooling period of time are appropriately set in accordance with the object of heat treatment for the treatment object X, the material of the treatment object X or the like.

The cooling device main body RH can perform cooling (immersion-cooling) in which the treatment object X is immersed in cooling water in addition to mist-cooling for the treatment object X using the above cooling water mist. In the immersion-cooling, cooling water (cooling medium) supplied from discharge nozzles 8 disposed in the bottom of the cooling room RS is stored in the cooling chamber 1, and the treatment object X is immersed in the cooling water inside the cooling chamber 1, thereby cooling the treatment object X. That is, portions on the discharge side (the downstream side) of the cooling pump 4 of the cooling medium circulator RJ shown in FIG. 2 are provided with switching valves 9*a* and 9*b*, and the cooling pump 4 supplies the cooling water to the mist headers 3 or to the discharge nozzles 8 in accordance with switching of the switching valves 9*a* and 9*b*. A pump having as small variation as possible of the discharge pressure of the cooling water when the discharge pressure varies with the passage of time is selected for the cooling pump 4.

The cooling medium circulator RJ is configured including a first collection passageway 30 and a second collection passageway 31 through which the cooling water is collected from the cooling device main body RH, a cooling water tank 32 that stores the cooling water collected through the first collection passageway 30 and the second collection passageway 31 (an overflow pipe), a first circulation passageway 33 connecting to the cooling water tank 32, and a second circulation passageway 34 branching from the first circulation passageway 33.

The first collection passageway 30 is formed of a pipe whose first end connects to the bottom of the cooling device main body RH and whose second end connects to the cooling water tank 32 and includes an on-off valve 35 provided in part of the route of the pipe. In this embodiment, the second end of the pipe forming the first collection passageway 30 is attached to a top cover (not shown) that covers and is attached to the cooling water tank 32. Accordingly, the pipe discharges, through the opening of the second end thereof to the water surface of the cooling water stored in the cooling water tank 32 from above, the cooling water collected from the cooling device main body RH.

The second collection passageway 31 is an overflow pipe formed of a pipe whose first end connects to the upper part of the cooling room RS of the cooling device main body RH and whose second end connects to the cooling water tank 32. In this embodiment, the second end of the pipe forming the second collection passageway 31 is also attached to the top cover that covers and is attached to the cooling water tank 32 and discharges, through the opening of the second end of the pipe to the water surface of the cooling water stored in the cooling water tank 32 from above, the cooling water collected from the cooling device main body RH. That is, when the water level of the cooling water supplied into the cooling room RS exceeds a predetermined water level inside the cooling room RS, the cooling water overflows and is drained from the cooling room RS through the second collection passageway 31 into the cooling water tank 32, and therefore the water level of the cooling water inside the cooling room RS is prevented from becoming higher than the position of the first end of the second collection passageway 31 connected to the cooling room RS.

The first collection passageway 30 is used for collecting the cooling water stored in the bottom inside the cooling room RS when the treatment object X is mist-cooled at the cooling device main body RH. The second collection passageway 31 is used for collecting the cooling water stored in the cooling room RS and overflowed therefrom when the treatment object X is immersion-cooled at the cooling device main body RH.

The cooling water tank 32 is, for example, a normal tank having a rectangular parallelepiped shape, and the underside of the cooling water tank 32 close to one short edge thereof is provided with a drainage port. The drainage port is connected to the first circulation passageway 33. The first circulation passageway 33 is a pipe whose first end connects to the drainage port of the cooling water tank 32 and whose second end connects to an injection nozzle 42 arranged to be close to the bottom inside the cooling water tank 32.

The injection nozzle 42 is arranged in a position close to the bottom inside the cooling water tank 32 and lower than the water surface of the cooling water stored in the cooling water tank 32. The injection nozzle 42 injects the cooling water circulated and returned through the first circulation passageway 33 into the cooling water stored in the cooling water tank 32 and thus forms a large flow of the cooling water inside the cooling water tank 32 in a horizontal direction, thereby stirring and mixing the cooling water therein. Accordingly, the cooling water collected from the cooling room RS through the first collection passageway 30 or the second collection passageway 31 and stored in the cooling water tank 32 and the cooling water circulated and returned through the first circulation passageway 33 are uniformly mixed.

The cooling pump 4 is provided in part of the route of the first circulation passageway 33. Accordingly, the cooling water is drained from the drainage port of the cooling water tank 32 and flows through the first circulation passageway 33. The cooling pump 4 is configured to perform continuous operation if it is in a normal state and thus is configured to operate and make the cooling water stored in the cooling water tank 32 flow into the first circulation passageway 33 during cooling for the treatment object X at the cooling room RS (the cooling device main body RH).

A heat exchanger 37 is provided in part of the route of the first circulation passageway 33 positioned on the downstream side of the cooling pump 4. The heat exchanger 37 is a generally known device that performs heat exchange between cooling water supplied from a cooler (a chiller, not shown) and the cooling water flowing through the first circulation passageway 33 and is configured to cool the cooling water flowing through the first circulation passageway 33 to, for example, about 30° C.

A constant flow valve 38 is provided in part of the route of the first circulation passageway 33 positioned between the cooling pump 4 and the heat exchanger 37. Under this configuration, the first circulation passageway 33 is configured to drain the cooling water stored in the cooling water tank 32, to cool the cooling water by causing the cooling water to pass through the heat exchanger 37 and to return the cooled cooling water into the cooling water tank 32.

The first circulation passageway 33 is provided with the second circulation passageway 34. The second circulation passageway 34 branches from part of the first circulation passageway 33 positioned on the downstream side of the cooling pump 4 and on the upstream side of the constant flow valve 38, namely on the upstream side of the heat exchanger 37, and connects to the cooling device main body RH. That is, the first circulation passageway 33 is connected with the pipe serving as the second circulation passageway 34. The pipe forming the second circulation passageway 34 branches into the pipe forming a first branch passageway 39 and the pipe forming a second branch passageway 40.

The pipe forming the first branch passageway 39 is provided with branch pipes 41 connecting to the mist headers 3, and the first branch passageway 39 connects to the cooling device main body RH via the branch pipes 41. That is, the cooling water drained from the cooling water tank 32 and flowing through the first branch passageway 39 of the second circulation passageway 34 is sprayed through the branch pipes 41 and the mist headers 3 from the cooling nozzles 2 into the cooling room RS. The switching valves 9*b* are provided in the branch pipes 41.

The pipe forming the second branch passageway 40 connects to headers (not shown) connecting to the discharge nozzles 8, and thus the second branch passageway 40 also connects to the cooling device main body RH. That is, the cooling water drained from the cooling water tank 32 and flowing through the second branch passageway 40 of the second circulation passageway 34 is discharged through the headers from the discharge nozzles 8 into the cooling room RS. The pipe forming the second branch passageway 40 is provided with the switching valve 9*a*.

In this embodiment, as shown in FIG. 2, the constant flow valve 38 is provided in the first circulation passageway 33 between the cooling pump 4 and the heat exchanger 37 and makes the flow rate of cooling water flowing through the pipe forming the first circulation passageway 33 be constant. The constant flow valve 38 is provided for regulating, to a constant flow rate, the flow rate of cooling water to be returned to the cooling water tank 32 through the first circulation passageway 33 when the flow rate of water discharged from the cooling pump 4 is increased by increasing the output of the cooling pump 4 in order to, for example, increase the spray pressure of cooling water sprayed from the cooling nozzles 2 of the cooling room RS, thereby increasing, in accordance with the output of the cooling pump 4, the flow rate of cooling water to be supplied into the second circulation passageway 34.

In a case where such a constant flow valve 38 is not provided therein, even if the flow rate of water discharged from the cooling pump 4 is increased by increasing the output of the cooling pump 4, the flow rate of cooling water to be supplied into the second circulation passageway 34 does not increase because the flow rate of cooling water to be returned to the cooling water tank 32 through the first circulation passageway 33 increases, and thus it is difficult to increase the spray pressure of the cooling water sprayed from the cooling nozzles 2 up to an intended pressure. However, since the constant flow valve 38 is provided therein, it is possible to easily increase the spray pressure of the cooling water sprayed from the cooling nozzles 2 up to an intended pressure by increasing the output of the cooling pump 4.

The pressure stabilizer RA is configured including a pressure sensor 51 that measures the pressure inside the cooling room RS, a pressure relief valve 52 that opens the internal area of the cooling room RS to the external area thereof through the second collection passageway 31 in order to decrease the pressure inside the cooling room RS, and a controller 53 that controls the pressure relief valve 52 based on the measurement results of the pressure sensor 51.

The pressure sensor 51 is provided inside the cooling room RS in a position higher than the end of the second collection passageway 31 connected to the upper part of the cooling room RS and measures the pressure inside the cooling room RS. The pressure sensor 51 outputs pressure measurement signals denoting the pressure of the cooling room RS to the controller 53.

The pressure relief valve 52 is provided in the second collection passageway 31. For example, the pressure relief valve 52 is provided in an exhaust port 31*a* (refer to FIG. 2) provided in the upper part of the second collection passageway 31. That is, the pressure relief valve 52 switches between opening and closing thereof and thereby switches between opening and closing of the exhaust port 31*a*. The pressure relief valve 52 is configured to communicate the internal and external areas of the cooling room RS with each other when the pressure relief valve 52 is opened.

The pressure relief valve 52 is configured to operate in accordance with control signals input from the controller 53 and to be opened when the pressure inside the cooling room RS becomes a pressure approximate to the atmospheric pressure (a pressure slightly lower than the atmospheric pressure, a second pressure value D2 described below). As a result, since the exhaust port 31*a* provided in the upper part of the second collection passageway 31 is opened, gas remaining inside the cooling room RS is released to the external area of the cooling room RS, and thus the pressure inside the cooling room RS is stabilized at the atmospheric pressure. In a case where such a pressure relief valve 52 is not provided therein, the pressure inside the cooling room RS may inappropriately increase, and thus an unfavorable situation such as an emergency stop of the heat treatment device M or the cooling device R may be caused.

The controller 53 is configured including a CPU (Central Processing Unit), a ROM (Read Only Memory), a RAM (Random Access Memory), interface circuits that are electrically connected to the pressure sensor 51 and the pressure relief valve 52 and send and receive various signals thereto and therefrom, and the like. The controller 53 performs communication with the pressure relief valve 52 and controls the operation of the pressure relief valve 52 based on various arithmetic and control programs stored in the ROM and the pressure measurement signals input from the pressure sensor 51. For example, the controller 53 controls the pressure relief valve 52 such that the pressure relief valve 52 is opened when the measurement result of the pressure sensor 51 is higher than or equal to the second pressure value D2 (a threshold value). That is, the controller 53 compares the measurement result (a pressure value) input from the pressure sensor 51 and denoting the pressure inside the cooling room RS with the second pressure value D2 (a threshold value) stored in the RAM or the like and opens the pressure relief valve 52 when the measurement result is higher than or equal to the second pressure value D2. The above comparison by the controller 53 is performed at predetermined time intervals. The second pressure value D2 is set to a value lower than that of the atmospheric pressure.

The pressurized gas supply device RG is configured including a pressurized gas tank 61 used to store pressurized gas (for example, nitrogen gas or air) that increases the pressure inside the cooling room RS, a pressurized gas pipe 63 that connects the pressurized gas tank 61 and the cooling chamber 1 and through which the pressurized gas flows from the pressurized gas tank 61 into the cooling room RS, and a valve 62 provided in part of the route of the pressurized gas pipe 63.

The pressurized gas tank 61 is a container that stores the pressurized gas and is connected to a first end of the pressurized gas pipe 63. For example, in a case where nitrogen gas that is inert gas is used for the pressurized gas, nitrogen gas or liquid nitrogen is stored in the pressurized gas tank 61. Nitrogen gas may be supplied into the pressurized gas tank 61 at appropriate timings.

The pressurized gas pipe 63 is a pipe whose first end connects to the pressurized gas tank 61 and whose second end connects to the cooling room RS (for example, to the upper part of the cooling room RS). Accordingly, the pressurized gas is drawn from the pressurized gas tank 61 and flows through the pressurized gas pipe 63.

The valve 62 can close the pressurized gas pipe 63 and switches execution and stop of supply of the pressurized gas to the cooling room RS through the pressurized gas pipe 63 through opening and closing of the valve 62. The opening and closing operation of the valve 62 is controlled by a controller (not shown). As described above, since the pressurized gas is stored in the pressurized gas tank 61, when the valve 62 is merely opened in accordance with the control of the controller, the pressurized gas inside the pressurized gas tank 61 can be supplied into the cooling room RS through the pressurized gas pipe 63. The valve 62 may regulate the flow rate of pressurized gas flowing through the pressurized gas pipe 63 to a constant flow rate similarly to the constant flow valve 38.

Returning to FIG. 1, the intermediate transfer device H is configured including a transfer chamber 10, a cooling room mount table 11, a cooling room lift table (not shown), a cooling room lift cylinder 13, a pair of conveyance rails 14, pusher cylinders 15 and 16, a heating room lift table 17, a heating room lift cylinder 18 and the like. The transfer chamber 10 is a casing provided between the cooling device R and the heating devices K1 and K2, and the internal space of the transfer chamber 10 is the transfer room HS. The treatment object X is loaded into the transfer chamber 10 through a loading-and-unloading port (not shown) by a conveyance device provided outside of the intermediate transfer device H in a state where the treatment object X is contained in a container (a storing container) such as a basket. The transfer chamber 10 is configured to be capable of bringing the transfer room HS provided thereinside into a vacuum state.

The cooling room mount table 11 is a support table on which the treatment object X is mounted when the treatment object X is cooled at the cooling device R and supports the treatment object X such that the underside of the treatment object X is as widely exposed as possible. The cooling room mount table 11 is provided on the top of the cooling room lift table (not shown). The cooling room lift table is a support table that supports the cooling room mount table 11, that is, supports the treatment object X through the cooling room mount table 11 and is fixed to the end of a movable rod of the cooling room lift cylinder 13.

The cooling room lift cylinder 13 is an actuator that vertically moves (lifts up and lowers) the cooling room lift table. That is, the cooling room lift cylinder 13 and the cooling room lift table are conveyance devices that are used exclusively for the cooling device R and convey the treatment object X mounted on the cooling room mount table 11 from the transfer room HS into the cooling room RS and convey it from the cooling room RS into the transfer room HS.

The pair of conveyance rails 14 is laid on the bottom inside the transfer chamber 10 so as to extend in a horizontal direction. The conveyance rails 14 are guide members that are used when the treatment object X is conveyed between the cooling device R and the heating device K1. The pusher cylinder 15 is an actuator that pushes the treatment object X in order to convey the treatment object X positioned inside the transfer chamber 10 toward the heating device K1. The pusher cylinder 16 is an actuator that pushes the treatment object X in order to convey the treatment object X from the heating device K1 toward the cooling device R.

That is, the pair of conveyance rails 14 and the pusher cylinders 15 and 16 are conveyance devices that are used exclusively for conveying the treatment object X between the heating device K1 and the cooling device R. Although the pair of conveyance rails 14 and the pusher cylinders 15 and 16 are shown in FIG. 1, the intermediate transfer device H of this embodiment includes three sets of two conveyance rails 14 and pusher cylinders 15 and 16. That is, the two conveyance rails 14 and the pusher cylinders 15 and 16 are not only provided for the heating device K1 but are also provided for each of the heating device K2 and the third heating device (not shown).

The heating room lift table 17 is a support table on which the treatment object X is mounted when the treatment object X is conveyed from the intermediate transfer device H into the heating device K1. That is, the treatment object X is pushed rightward in FIG. 1 by the pusher cylinder 15 and thus is conveyed to a position on the heating room lift table 17. The heating room lift cylinder 18 is an actuator that vertically moves (lifts up and lowers) the treatment object X placed on the heating room lift table 17. That is, the heating room lift table 17 and the heating room lift cylinder 18 are conveyance devices that are used exclusively for the heating device K1 and convey the treatment object X mounted on the heating room lift table 17 from the transfer room HS into the internal area (a heating room KS) of the heating device K1 and convey it from the heating room KS into the transfer room HS.

The heating devices K1 and K2 and the third heating device have approximately the same configuration. Therefore, hereinafter, the configuration of the heating device K1 is described on their behalf. The heating device K1 includes a heating chamber 20, a thermal insulation casing 21, heaters 22, a vacuum extraction pipe 23, a vacuum pump 24, a stirring blade 25, a stirring motor 26 and the like.

The heating chamber 20 is a casing provided above the transfer chamber 10, and the internal space of the heating chamber 20 is the heating room KS. The heating chamber 20 is a vertical cylindrical casing (a casing whose central axis line is parallel with the vertical direction) similar to the cooling chamber 1 and is formed in a smaller size than that of the cooling chamber 1. The thermal insulation casing 21 is a vertical cylindrical casing provided inside the heating chamber 20 and is formed of a thermal insulation material having a predetermined thermal insulation property.

The heaters 22 are bar-shaped heating elements and are provided so as to vertically extend inside the thermal insulation casing 21 at predetermined intervals in the circumferential direction of the thermal insulation casing 21. The heaters 22 heat the treatment object X accommodated in the heating room KS to an intended temperature (a heating temperature). The heating conditions such as the heating temperature and the heating period of time are appropriately set in accordance with the purpose of heat treatment for the treatment object X, the material of the treatment object X and the like.

The above heating conditions include a vacuum degree (a pressure) inside the heating room KS (the heating chamber 20). The vacuum extraction pipe 23 is a pipe communicating with the heating room KS, and a first end of the vacuum extraction pipe 23 is connected to the top of the thermal insulation casing 21, and a second end thereof is connected to the vacuum pump 24. The vacuum pump 24 is an air extraction pump that draws air being inside the heating room KS through the vacuum extraction pipe 23. The vacuum degree inside the heating room KS is determined by the extraction volume of air of the vacuum pump 24.

The stirring blade 25 is a rotary blade provided in the upper part inside the thermal insulation casing 21 in an attitude in which the rotary shaft thereof extends in the vertical direction (the up-and-down direction). The stirring blade 25 is driven by the stirring motor 26 and thereby stirs air inside the heating room KS. The stirring motor 26 is a rotational driver that is provided on the heating chamber 20 such that the output shaft thereof is parallel with the vertical direction (the up-and-down direction). The stirring motor 26 is provided on the upper outer surface of the heating chamber 20, and the output shaft of the stirring motor 26 penetrates the wall of the heating chamber 20. The output shaft of the stirring motor 26 is connected to the rotary shaft of the stirring blade 25 positioned inside the heating chamber 20 without spoiling the airtightness (the sealing property) of the heating chamber 20.

Although not shown in FIG. 1, the heat treatment device M of this embodiment includes a controller that is used exclusively therefor. The controller includes an operating portion that is used in order that a user inputs various conditions of heat treatment thereinto and sets them, and a control portion that controls each component of the cooling pump 4, the heaters 22, the cylinders, the vacuum pump 24, the valve 62 and the like based on control programs or the like stored therein beforehand and thereby carries out heat treatment on the treatment object X in accordance with the set information. The controller particularly controls the cooling pump 4 such that the cooling pump 4 performs continuous operation if it is in a normal state as described above.

Next, the operation (a heat treatment method) of the heat treatment device having the above configuration, particularly the operation (a cooling treatment method) of the cooling device R, is described in detail. The above controller dominantly carries out the operation of the heat treatment device based on the set information. As it is well known, there are various kinds of heat treatment for different purposes. Hereinafter, the operation of hardening the treatment object X is described as an example of heat treatment.

In hardening, for example, the treatment object X is heated up to a temperature higher than a temperature T1, thereafter is rapidly cooled from the temperature T1 to a temperature T2, thereafter is maintained at the temperature T2 for a period of time and thereafter is slowly cooled, whereby the hardening is finished. The treatment object X having been carried into the intermediate transfer device H through the loading-and-unloading port by the external conveyance device is conveyed onto the heating room lift table 17 through, for example, the operation of the pusher cylinder 15 and is carried into the heating room KS through the operation of the heating room lift cylinder 18.

Then, the treatment object X is heated to a temperature higher than the temperature T1 by the heaters 22 that are energized for a period of time, and predetermined heat treatment is performed on the treatment object X. Thereafter, the treatment object X is conveyed onto the cooling room mount table 11 through the operation of the heating room lift cylinder 18 and the operation of the pusher cylinder 16. Then, the treatment object X is conveyed into the cooling room RS through the operation of the cooling room lift cylinder 13. During conveyance of the treatment object X between the transfer room HS, the heating room KS and the cooling room RS, these three rooms are maintained in a vacuum state.

A predetermined cooling process, namely one cooling process of mist-cooling and immersion-cooling, is performed on the treatment object X conveyed into the cooling room RS.

In a case where the treatment object X is mist-cooled at the cooling room RS, the conveyed treatment object X is accommodated in the cooling room RS, and thereafter the switching valve 9*a* is closed and the switching valves 9*b* are opened in the branch passageways of the second circulation passageway 34 positioned on the discharge port-side of the cooling pump 4 performing continuous operation, thereby causing the cooling water to flow through the first branch passageway 39. Accordingly, the cooling nozzles 2 are selected as the supply destination of the cooling water, and droplets (mist) of the cooling water are sprayed from the cooling nozzles 2 onto the treatment object X. That is, the treatment object X is mist-cooled by the droplets of the cooling water sprayed from the cooling nozzles 2. In the mist-cooling, the cooling water sprayed from the cooling nozzles 2 is continuously returned to the cooling water tank 32 through the first collection passageway 30 shown in FIG. 2.

In a case where the treatment object X is immersion-cooled, before the treatment object X is accommodated in the cooling room RS, the cooling nozzles 2 are selected as the supply destination of the cooling water in the same manner as the above mist-cooling, and droplets of the cooling water are sprayed from the cooling nozzles 2 in a state where the on-off valve 35 is closed, thereby storing the cooling water in the cooling room RS to a predetermined water level. Subsequently, the switching valve 9*a* is opened, and the switching valves 9*b* are closed, whereby the discharge nozzles 8 are selected as the supply destination of the cooling water. In a case where the immersion-cooling is performed, the cooling water is not sprayed from the cooling nozzles 2, the switching valve 9*a* is opened, and the switching valves 9*b* are closed, whereby the cooling water is caused to flow through the second branch passageway 40, and thus the discharge nozzles 8 may be selected as the supply destination of the cooling water.

The cooling medium is supplied from the discharge nozzles 8 in this way, whereby the cooling room RS is filled with the cooling water. Subsequently, the treatment object X is accommodated in the cooling room RS filled with the cooling water, whereby the immersion-cooling is performed. Accordingly, the treatment object X is immersed in the cooling water and is rapidly cooled to the temperature T2. The immersion-cooling is performed for a predetermined period of time, and during the immersion-cooling, the cooling water is continuously supplied from the discharge nozzles 8 into the cooling room RS, whereby the cooling water inside the cooling room RS is stirred. The cooling water overflowed from the connection part between the second collection passageway 31 and the cooling room RS shown in FIG. 2 is returned to the cooling water tank 32 through the second collection passageway 31. Then, when the immersion-cooling is finished, the on-off valve 35 is opened, and the cooling water inside the cooling room RS is returned to the cooling water tank 32 through the first collection passageway 30 in a short time, whereby the treatment object X switches from a state of being immersed in the cooling water (the cooling medium) to a state of being placed in the atmosphere in a short time.

Hereinafter, the operation of the cooling device R during mist-cooling for the treatment object X is described in detail.

Figure 3:
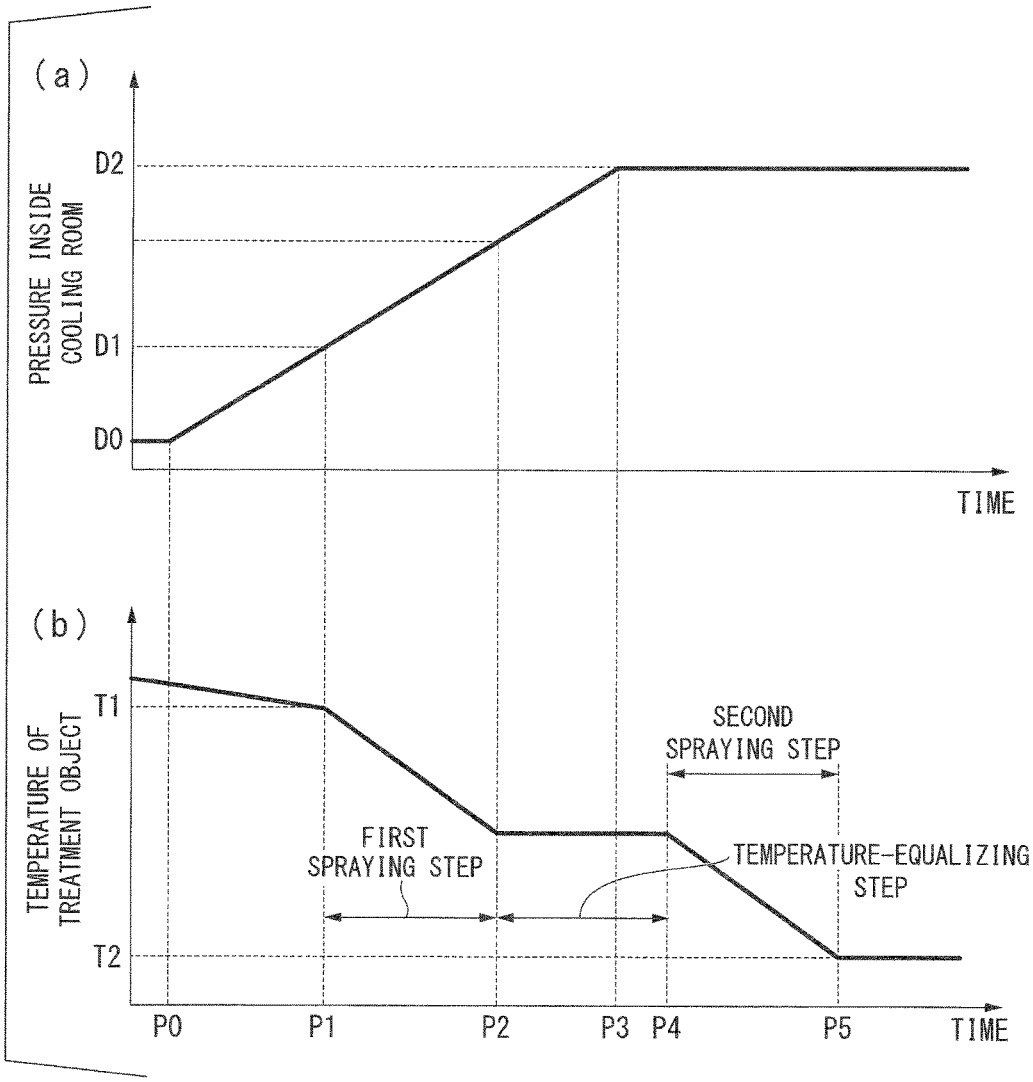
FIG. 3 is a graph showing pressure change inside a cooling room and temperature change of a treatment object of the embodiment of the present disclosure.

FIG. 3 is a graph showing pressure change inside the cooling room RS and temperature change of the treatment object X, a graph positioned in the upper part of FIG. 3 shows the pressure change inside the cooling room RS, and a graph positioned in the lower part of FIG. 3 shows the temperature change of the treatment object X. Hereinafter, the graph positioned in the upper part of FIG. 3 may be referred to as FIG. 3(*a*), and the graph positioned in the lower part of FIG. 3 may be referred to as FIG. 3(*b*). The horizontal axes of FIGS. 3(*a*) and 3(*b*) show the same temporal axis.

The treatment object X heated by the heating device to a temperature higher than the temperature T1 is carried into the cooling room RS via the intermediate transfer device H.

As described above, the transfer room HS and the cooling room RS are maintained in a vacuum state during conveyance of the treatment object X, and the pressure inside the cooling room RS in the vacuum state is referred to as a pressure D0. The temperature of the treatment object X heated to a temperature higher than the temperature T1 gradually falls due to heat radiation during the conveyance.

When the treatment object X is carried into the cooling room RS, an opening (not shown) of the cooling chamber 1 through which the treatment object X is conveyed is closed, and thus the cooling room RS is brought into a sealed state. At the time P0 shown in FIG. 3, the valve 62 of the pressurized gas supply device RG is opened in accordance with the control of the above controller. Since the cooling room RS is maintained in a vacuum state and pressurized gas (or a liquid obtained by condensing pressurized gas) is stored in the pressurized gas tank 61, when the valve 62 is merely opened, the pressurized gas inside the pressurized gas tank 61 is supplied into the cooling room RS through the pressurized gas pipe 63. The pressurized gas is supplied into the cooling room RS at a constant flow rate, and the pressure inside the cooling room RS gradually increases with passage of time (refer to FIG. 3(*a*)). The supply of the pressurized gas is performed until the pressure inside the cooling room RS reaches the second pressure value D2 described below.

At the time P1 at which the pressure inside the cooling room RS becomes a first pressure value D1 through supply of the pressurized gas, a first spraying step is started in which cooling water (mist) is sprayed from the cooling nozzles 2 onto the treatment object X. It is possible that the cooling pump 4 does not appropriately operate if the pressure inside the cooling room RS is too low, and thus the first pressure value D1 is set to a pressure value in which the cooling pump 4 can appropriately operate and the cooling nozzles 2 can appropriately spray the cooling water. Since the temperature of the treatment object X at the time P1 is the temperature T1, the cooling process for the treatment object X is started from the temperature T1. The sprayed cooling water (mist) contacts the treatment object X having a high temperature and vaporizes thereat, whereby the treatment object X is deprived of heat through vaporization of the cooling water and thus is cooled.

In the mist-cooling of this embodiment, following the first spraying step, a temperature-equalizing step (a stop period of supply of the cooling medium) is performed from a time P2 to a time P4. The temperature-equalizing step is performed in order to decrease the difference between the temperatures of the inside and the outer surface of the treatment object X caused by rapid mist-cooling. In the temperature-equalizing step, the spray of the cooling water from the cooling nozzles 2 is stopped. In this embodiment, the pressure inside the cooling room RS at the time P2 is lower than the atmospheric pressure. At a time P3 between the time P2 and the time P4, the pressure inside the cooling room RS reaches the second pressure value D2 slightly lower than the atmospheric pressure, and thereafter the cooling room RS is opened to the atmosphere, whereby the pressure inside the cooling room RS becomes equal to the atmospheric pressure. Since the second pressure value D2 is a pressure close to the atmospheric pressure, for the sake of convenience, in FIG. 3(*a*), the second pressure value D2 and the atmospheric pressure are shown to appear to be the same value. The above-described temperature-equalizing step is performed, whereby the difference between the temperatures of the inside and the outer surface of the treatment object X is decreased. As a result, it is possible to limit non-uniformity in properties of the treatment object X and deformation thereof.

Following the temperature-equalizing step, a second supplying step is performed from the time P4 to a time P5. In the second supplying step, similarly to the first spraying step, the cooling water (mist) is sprayed from the cooling nozzles 2 onto the treatment object X. The second supplying step is performed, whereby the treatment object X is cooled to the temperature T2. The treatment object X is slowly cooled from the time P5 at which the temperature of the treatment object X is the temperature T2, and thus the mist-cooling of this embodiment is finished.

Next, the operation of the pressure stabilizer RA during the above-described mist-cooling is described.

In the mist-cooling described above using FIG. 3, the pressure inside the cooling room RS at the time P2 at which the temperature-equalizing step is started is lower than the atmospheric pressure or the second pressure value D2. In a case where the surface of the treatment object X is provided with recesses or the like, the cooling water may be stored in the recesses or the like at the time the first spraying step is finished. At the time P2, the treatment object X may have a sufficient temperature to vaporize the cooling water depending on the temperature profiles of the cooling process for the treatment object X.

If a large amount of cooling water is attached to the treatment object X and the temperature of the treatment object X is high at the time P2 at which the temperature-equalizing step is started, in the temperature-equalizing step, vapor continues to be generated through vaporization of the cooling water attached to the treatment object X. In contrast, the spray of the cooling water from the cooling nozzles 2 stops, and the vapor generated from the treatment object X remains inside the cooling room RS without being cooled by the cooling water supplied from the cooling nozzles 2. Therefore, the pressure inside the cooling room RS may unexpectedly and sharply increase due to the generated vapor, and an unfavorable situation such as an emergency stop of the heat treatment device M or the cooling device R may be caused due to the increase of the pressure inside the cooling room RS.

However, the cooling device R of this embodiment includes the pressure stabilizer RA, and the controller 53 of the pressure stabilizer RA compares a measurement result (a pressure value) input from the pressure sensor 51 and denoting the pressure inside the cooling room RS with the second pressure value D2 (a threshold value) at predetermined time intervals. Therefore, even if the pressure inside the cooling room RS sharply increases, when the measurement result becomes higher than or equal to the second pressure value D2, the controller 53 opens the pressure relief valve 52. Since the internal and external areas of the cooling room RS are communicated with each other through the second collection passageway 31 and the exhaust port 31*a* when the pressure relief valve 52 is opened, the pressure inside the cooling room RS smoothly becomes equal to the atmospheric pressure. Thus, even if vapor continues to be generated in the temperature-equalizing step of this embodiment through vaporization of the cooling water attached to the treatment object X, it is possible to prevent the pressure inside the cooling room RS from exceeding the atmospheric pressure. Consequently, an emergency stop of the heat treatment device M or the cooling device R can be prevented, and thus a high processing efficiency of the treatment object can be maintained.

A little time (a time lag) may be needed from the pressure measurement of the pressure sensor 51 to the opening movement of the pressure relief valve 52. Accordingly, the second pressure value D2 is set to a value lower than the atmospheric pressure in order to reliably prevent the pressure inside the cooling room RS from exceeding the atmospheric pressure. The second pressure value D2 may be appropriately adjusted in view of the above time lag or the like.

Since it is difficult to anticipate what case in which sharp increase of the pressure inside the cooling room RS occurs, the comparison of a measurement result (a pressure value) of the pressure sensor 51 with the second pressure value D2 (a threshold value) by the controller 53 is performed at predetermined time intervals. Therefore, even if the pressure inside the cooling room RS gradually increases with passage of time as shown in FIG. 3(*a*) without sharply increasing, the controller 53 opens the pressure relief valve 52 when the pressure inside the cooling room RS is higher than or equal to the second pressure value D2, and thus the internal and external areas of the cooling room RS are communicated with each other through the pressure relief valve 52 and the like. That is, in the normal cooling process in which the pressure inside the cooling room RS does not sharply increase, when the pressure inside the cooling room RS reaches the second pressure value D2, the opening of the cooling room RS to the atmosphere is also performed by the pressure relief valve 52.

According to this embodiment, the cooling device R includes the pressure relief valve 52 that is provided in the second collection passageway 31 connected to the cooling room RS and causes the pressure inside the cooling room RS to be equal to the atmospheric pressure when the pressure relief valve 52 is opened. Therefore, even if the pressure inside the cooling room RS has become high, the pressure relief valve 52 is opened, thereby causing the pressure inside the cooling room RS to be equal to the atmospheric pressure, and thus it is possible to prevent inappropriate increase of the pressure inside the cooling room RS exceeding the atmospheric pressure. In addition, according to this embodiment, since the pressure relief valve 52 is provided in the conventionally installed second collection passageway 31 (an overflow pipe), it is possible to prevent increase of the pressure inside the cooling room RS exceeding the atmospheric pressure without extensive modification for the cooling device R.

Hereinbefore, an embodiment of the present disclosure is described, but the present disclosure is not limited to the above embodiment. The shape, the combination or the like of each component shown in the above embodiment is an example, and addition, omission, replacement, and other modifications of a configuration based on a design request or the like can be adopted within the scope of the present disclosure. For example, the following modifications may be adopted.

(1) In the above embodiment, the pressure relief valve 52 is attached to the second collection passageway 31 that is an overflow pipe, but the present disclosure is not limited thereto. For example, the pressure relief valve 52 may be provided in an exhaust pipe (a pipe capable of communicating the internal and external areas of the cooling room RS with each other, not shown) provided in the cooling device R, vapor inside the cooling room RS may be discharged into the external area thereof through the exhaust pipe, and thus the pressure inside the cooling room RS may be caused to be equal to the atmospheric pressure. Without using pipes, an opening may be provided in the wall of the cooling room RS (the cooling chamber 1) and may be attached with the pressure relief valve 52.

(2) In the above embodiment, the valve 62 is provided in part of the route of the pressurized gas pipe 63, but the present disclosure is not limited thereto. For example, in a case where the supply velocity of pressurized gas from the pressurized gas tank 61 into the cooling room RS has to be increased, a supply pump that discharges pressurized gas toward the cooling room RS may be provided in part of the route of the pressurized gas pipe 63 instead of the valve 62 or in addition to the valve 62. When the supply pump is operated during supply of the pressurized gas, the supply velocity of the pressurized gas can be increased.

(3) In the mist-cooling of the above embodiment, the pressure inside the cooling room RS is lower than the atmospheric pressure at the time P2 at which the temperature-equalizing step is started. However, the second supplying step may be started at the time the pressure inside the cooling room RS has already become equal to the atmospheric pressure. That is, during performance of the first spraying step, the pressure inside the cooling room RS may reach the second pressure value D2, and as a result, the pressure inside the cooling room RS may become equal to the atmospheric pressure.

(4) In the mist-cooling of the above embodiment, the temperature-equalizing step that is a stop period of supply of coolant into the cooling room RS is provided once during cooling for the treatment object X. However, a plurality of stop periods of supply of coolant may be provided during cooling for the treatment object X. That is, coolant-spraying steps may be intermittently performed. In other words, the spraying step and the temperature-equalizing step may be alternately performed.

(5) Although water is used for the cooling medium in the above embodiment, alternative chlorofluorocarbons, organic solvents or the like can be used for the cooling medium.

(6) Although the heat treatment device M is described in the above embodiment, the present disclosure can be applied to a cooling device having no heating device. In this case, the cooling device includes the pressurized gas supply device RG, the pressure relief valve 52, the pressure sensor 51, the controller 53 and the like.

INDUSTRIAL APPLICABILITY

The present disclosure can be used for a heat treatment device and a cooling device that spray coolant onto a treatment object and thus cool it.

The invention claimed is:

1. A heat treatment device, comprising:

a heating device that heats a treatment object;

a cooling device including a cooling room that accommodates the treatment object heated by the heating device and into which a vaporizable cooling liquid used for cooling the treatment object is supplied, the cooling room being configured to maintain a vacuum state therein;

a pressurized gas supplier that supplies pressurized gas into the cooling room;

a pressure relief valve that communicates internal and external areas of the cooling room with each other to make the cooling room open to the atmosphere when the pressure relief valve is opened;

a pressure sensor that measures a pressure inside the cooling room; and a controller that controls the pressure relief valve such that the pressure relief valve is opened when a measurement result of the pressure sensor is higher than or equal to a threshold value set to a value lower than that of atmospheric pressure;

wherein the cooling device is configured such that at least one stop period of supply of the cooling liquid into the cooling room is provided during cooling for the treatment object.

2. The heat treatment device according to claim 1, wherein a pipe capable of communicating the internal and external areas of the cooling room with each other is connected to the cooling room, and wherein the pressure relief valve is provided in the pipe and is capable of closing the pipe.

3. The heat treatment device according to claim 2, wherein the pipe is an overflow pipe through which the cooling liquid is drained from the cooling room.

4. A cooling device, comprising:

a cooling room that accommodates a treatment object and into which a vaporizable cooling liquid used for cooling the treatment object is supplied, the cooling room being configured to maintain a vacuum state therein;

a pressurized gas supplier that supplies pressurized gas into the cooling room;

a pressure relief valve that communicates internal and external areas of the cooling room with each other to make the cooling room open to the atmosphere when the pressure relief valve is opened;

a pressure sensor that measures a pressure inside the cooling room;

a controller that controls the pressure relief valve such that the pressure relief valve is opened when a measurement result of the pressure sensor is higher than or equal to a threshold value set to a value lower than that of atmospheric pressure.

5. The heat treatment device according to claim 1, wherein the cooling device further includes a cooling nozzle that sprays the cooling liquid onto the treatment object inside the cooling room.

6. The heat treatment device according to claim 1, wherein the controller, based on control programs stored therein beforehand, supplies the cooling liquid into the cooling room when the pressure inside the cooling room reaches a predetermined pressure value higher than that of the vacuum state by the pressurized gas supplier supplying the pressurized gas into the cooling room maintained in the vacuum state.

7. The heat treatment device according to claim 1, wherein the cooling device further includes a cooling nozzle that sprays the cooling liquid onto the treatment object inside the cooling room, and wherein the controller, based on control programs stored therein beforehand, supplies the cooling liquid into the cooling room when the pressure inside the cooling room reaches a predetermined pressure value higher than that of the vacuum state by the pressurized gas supplier supplying the pressurized gas into the cooling room maintained in the vacuum state.

8. The cooling device according to claim 4, further comprising:

a cooling nozzle that sprays the cooling liquid onto the treatment object inside the cooling room.

9. The cooling device according to claim 4, wherein the controller, based on control programs stored therein beforehand, supplies the cooling liquid into the cooling room when the pressure inside the cooling room reaches a predetermined pressure value higher than that of the vacuum state by the pressurized gas supplier supplying the pressurized gas into the cooling room maintained in the vacuum state.

10. The cooling device according to claim 4, further comprising:

a cooling nozzle that sprays the cooling liquid onto the treatment object inside the cooling room, wherein the controller, based on control programs stored therein beforehand, supplies the cooling liquid into the cooling room when the pressure inside the cooling room reaches a predetermined pressure value higher than that of the vacuum state by the pressurized gas supplier supplying the pressurized gas into the cooling room maintained in the vacuum state.

* * * * *